United States Patent [19]

Satterwhite

[11] 3,982,340

[45] Sept. 28, 1976

[54] TWO WHEEL EXCAVATING AND LOADING SYSTEM

[75] Inventor: Charles R. Satterwhite, Dallas, Tex.

[73] Assignee: Unit Rig and Equipment Co., Tulsa, Okla.

[22] Filed: July 17, 1975

[21] Appl. No.: 596,677

Related U.S. Application Data

[63] Continuation-in-part of Ser. No. 435,296, Jan. 21, 1974, Pat. No. 3,896,571.

[52] U.S. Cl. ..... 37/190; 299/64

[51] Int. Cl.[2] ..... E02F 3/24

[58] Field of Search ..... 37/189, 190, DIG. 2, 37/94–97, 87; 172/112, 96; 299/74–78, 71, 64

[56] References Cited

UNITED STATES PATENTS

| | | | |
|---|---|---|---|
| 1,482,904 | 2/1924 | Moore et al. | 37/97 X |
| 1,858,327 | 5/1932 | Hays | 37/190 X |
| 1,912,743 | 6/1933 | Vaughn | 37/DIG. 2 |
| 2,748,505 | 6/1956 | Turner | 37/96 |
| 2,758,826 | 8/1956 | Paget | 37/190 X |
| 2,762,141 | 9/1956 | Le Tourneau | 37/190 |
| 3,091,874 | 6/1963 | Wuigk | 37/190 B |
| 3,171,220 | 3/1965 | Schram | 37/189 X |
| 3,290,096 | 12/1966 | Stalker | 299/78 |
| 3,712,679 | 1/1973 | Amorosco | 299/76 |
| R16,997 | 6/1928 | Barber | 37/DIG. 2 |

FOREIGN PATENTS OR APPLICATIONS

| | | | |
|---|---|---|---|
| 1,063,277 | 12/1953 | France | 37/190 |
| 722,876 | 3/1932 | France | 37/190 |
| 535,432 | 11/1955 | Italy | 172/112 |

*Primary Examiner*—E. H. Eickholt
*Attorney, Agent, or Firm*—Richards, Harris and Medlock

[57] ABSTRACT

An excavating and loading system includes an excavating and wheel assembly at the front thereof and a plurality of conveyors for conveying the material from the excavating wheel assembly upward and rearwardly. The excavating wheel assembly includes a pair of excavating wheels with a total width wider than the overall width of the following portions of the system. A supporting and housing apparatus extends between the excavating wheels and rotatably supports the same from the front of the vehicle. A power plant is provided and a drive shaft extends down along the supporting and housing means between the two excavating wheels. Gearing is provided in the interior of the wheels and is connected to the drive shaft for powering the excavating wheels. Apparatus is provided for raising and lowering excavation height of the excavation wheel assembly to thereby vary the grade of the excavation. The excavating wheels are provided with means for positively moving the walls of a plurality of buckets between material receiving and material discharge positions.

17 Claims, 12 Drawing Figures

TWO WHEEL EXCAVATING AND LOADING SYSTEM

CROSS REFERENCE TO RELATED APPLICATION

This application is a Continuation-in-Part of copending application Ser. No. 435,296, filed Jan. 21, 1974, for MULTI-WHEELED EXCAVATOR AND CONVEYING SYSTEM, now U.S. Pat. No. 3,896,571, granted July 29, 1975.

BACKGROUND AND SUMMARY OF THE INVENTION

The present invention relates to improvements in excavating and loading systems which form an excavation of a sufficient width to allow the following portion of the system to move through the excavation.

In large excavating and loading systems, for example, of the type capable of loading 4,000 yards of earth per hour, it has heretofore been known to utilize a system which forms a trench in the ground of a sufficient width to allow the system to move through the trench behind the excavating portion of the system. However, although various examples of such excavating and loading systems have been designed previously, the needs persist for considerable improvement in the art.

In accordance with the broader aspects of the present invention, an improved excavating and loading system is disclosed including a vehicle and an excavating wheel assembly supported at the front of the vehicle. The excavating wheel assembly comprises two excavating wheels which are supported by supporting and housing apparatus from the front of the vehicle. The supporting and housing apparatus extends between the excavating wheels to support the same to rotate about horizontal axis. A power supply is provided with a drive shaft that extends between the two excavating wheels and is coupled to drive the wheels.

In accordance with the preferred embodiment of the present invention, an improved excavating and loading system is disclosed having a vehicle which comprises a frame which is supported on the ground surface from driven wheels. A supporting and housing apparatus rotatably supports an excavating wheel assembly comprising two excavating wheels at the front of the vehicle in a position to rotate about horizontally extending axes. The supporting and housing apparatus has a portion which extends between the facing ends of the excavating wheels. The combined width of the excavating wheels is wider than the following portion of the vehicle. A power supply is provided on the vehicle and a drive shaft extends downwardly along the forward extending portion of the supporting and housing means. A right angle gearbox is driven by the drive shaft and is in turn coupled to the excavating wheels. Each of the excavating wheels includes a plurality of digging buckets each including a wall which is supported for movement between a material receiving position and a material discharge position. Structure is provided for operation of the movable bucket walls to first receive material and to subsequently discharge the material onto a conveyor supported from the vehicle. A main conveyor conveys material upwardly and rearwardly. An auxiliary conveyor with inner and outer portions can be provided on the rear of the vehicle for receiving the material from the main conveyor and for transporting material rearwardly and/or laterally.

DESCRIPTION OF THE DRAWINGS

A more complete understanding of the present invention can be had by referring to the following detailed description when taken in conjunction with the accompanying Drawings wherein.

DETAILED DESCRIPTION

Figure 1:
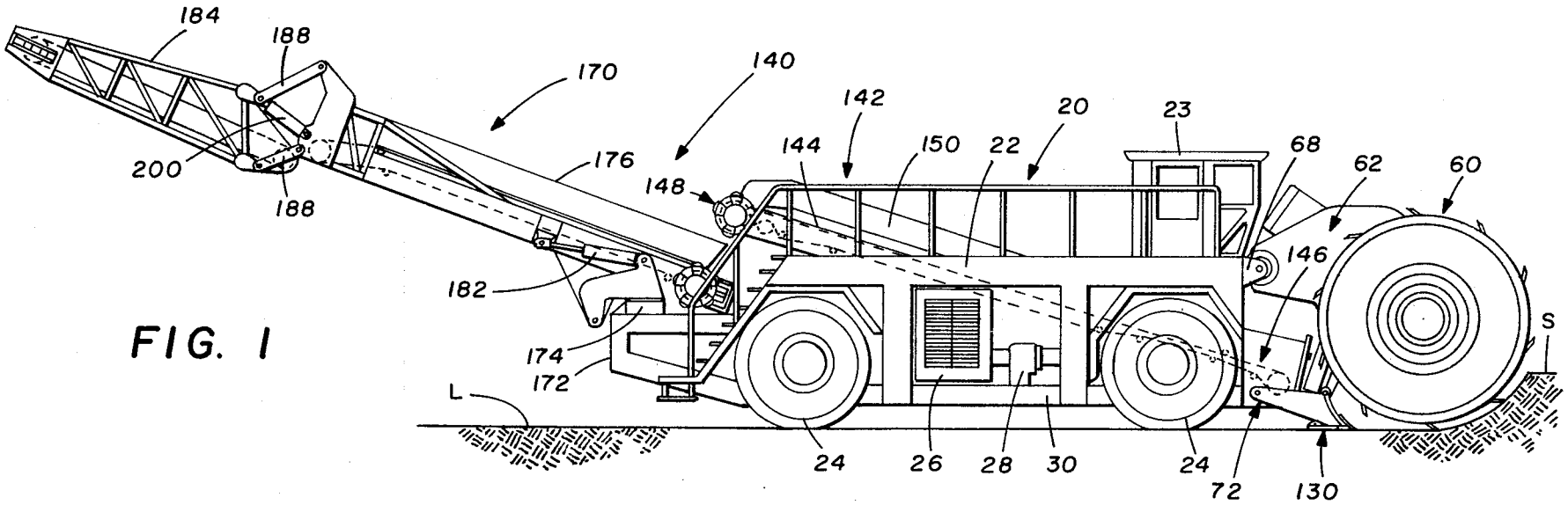
FIG. 1 is a side elevation of one embodiment of an excavating and loading system comprising the present invention.

Referring now to the Drawings, and particularly to FIG. 1, an excavating and loading system 20 incorporating the invention is shown. The system 20 comprises a vehicle 22 with an operator cab 23 and wheels 24 for movement along a surface L. Each of the wheels 24 is of the tire type and is adapted for movement over highways and other paved surfaces as well as for operation in unpaved areas, such as during excavation operations. It is apparent to those skilled in the art that the vehicle which will be hereafter described in detail could be provided with other types of wheels and frames such as track-type wheels and the like.

In accordance with the illustrated embodiments of FIGS. 1–4 an engine 26 is supported on the frame 30. The engine 26 is preferably of the internal combustion type and functions in one embodiment to drive an electric generator and in another to drive hydraulic pumps 28. The hydraulic pumps in turn supply operating power through suitable controls in the cab 23 to various components of the excavating and loading system 20. For example, one of the pumps supplies operating power for a hydrostatic drive, which is in turn coupled to a transmission. The transmission in turn provides driving power for the wheels 24 to propel the excavating and loading system 20 during excavating operations and during travel. In an alternate embodiment, the engine can drive an electrical generator which in turn supplies power to the system.

Figure 2:
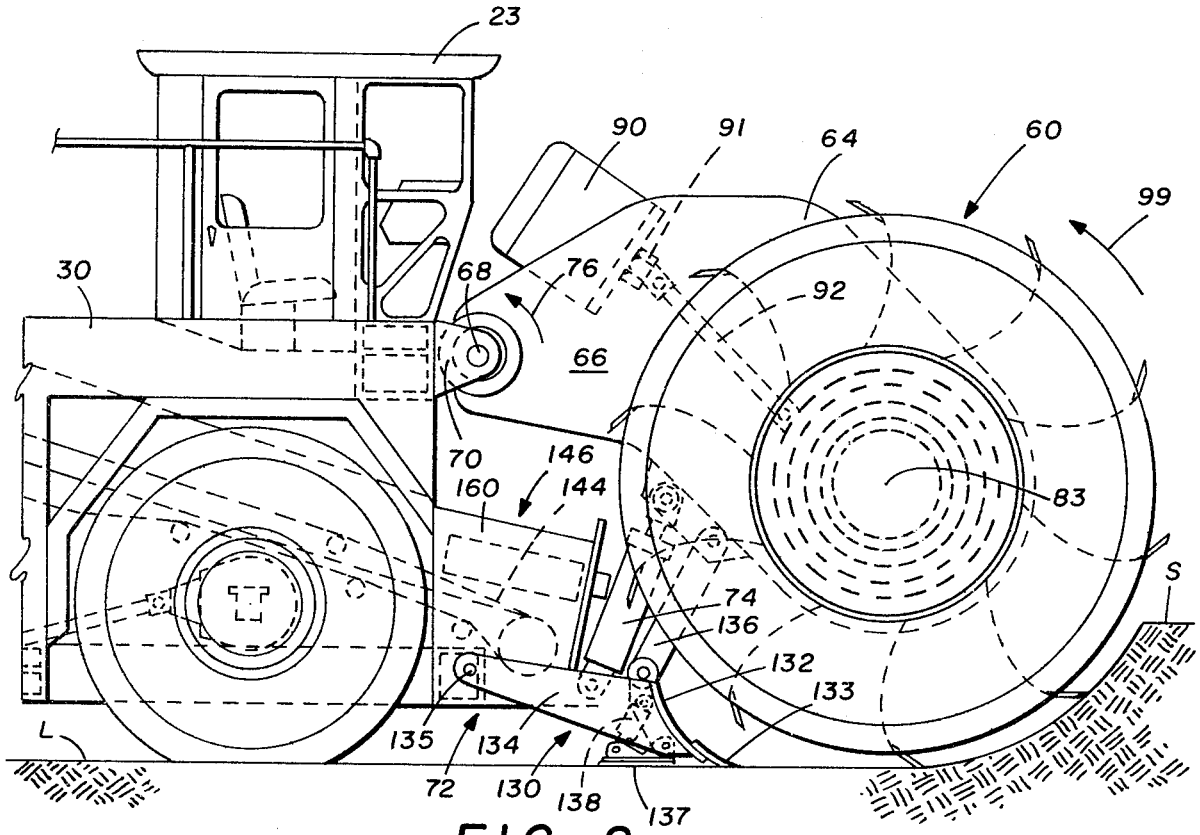
FIG. 2 is a partial enlarged side elevation of the front portion of the excavating and loading system illustrated in FIG. 1.
Figure 3:
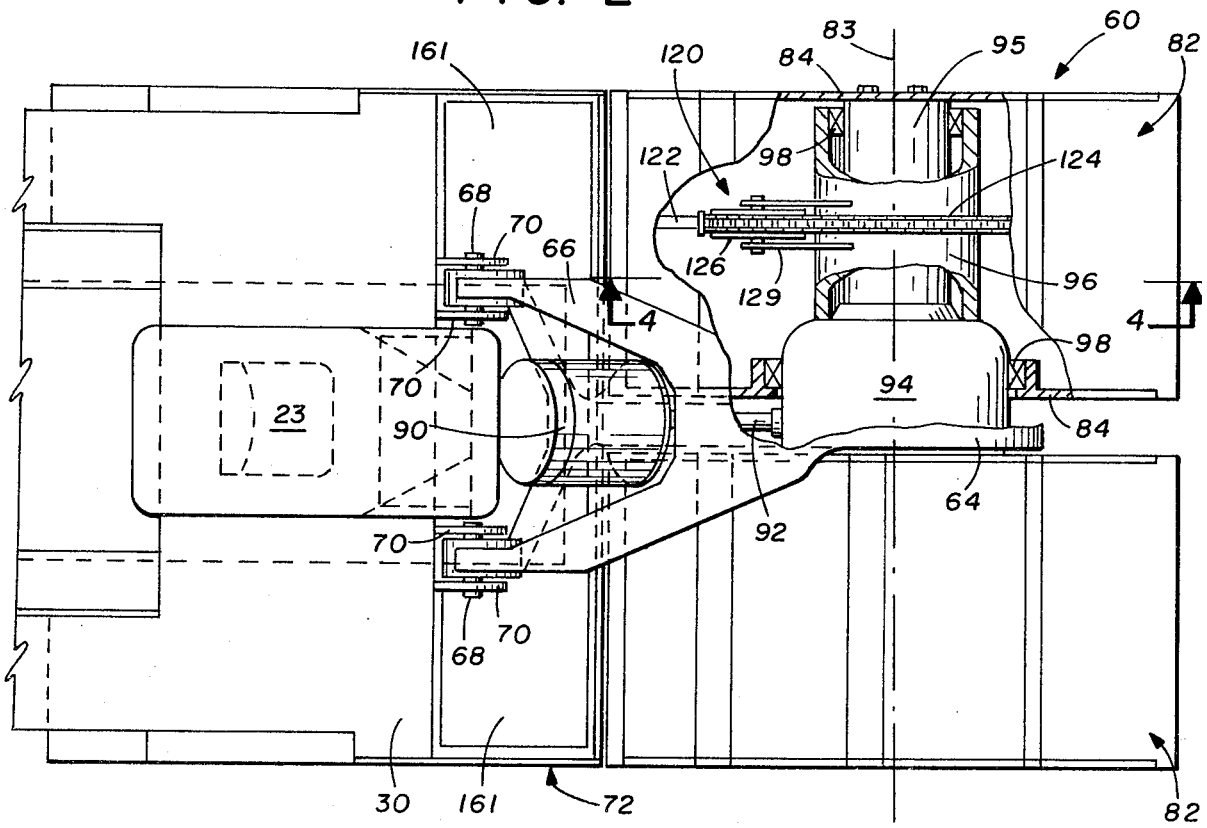
FIG. 3 is a partial enlarged plan view of the front portion of the excavating and loading system illustrated in FIG. 1.

An excavating wheel assembly 60 is positioned on the forward portion of the vehicle 22. The excavating wheel assembly 60 includes a supporting and housing apparatus 62 supported from the front of the frame 30. As can be seen in FIGS. 2 and 3, the supporting and housing apparatus 62 comprises a central portion 64 which extends from a bifurcated frame portion 66. The bifurcated frame portion 66 is pivotally supported on horizontal extending shafts 68. These shafts 68 are in turn mounted on brackets 70 extending from the upper portion of the front of the frame 30. Suitable bearing means are provided to allow rotation of the supporting and housing apparatus 62 about the shafts 68.

Portion 72 extends from the lower front of frame 30. A double-acting hydraulic cylinder means 74 is pivotally connected between the portion 72 and bifurcated frame portion 66. By selectively actuating the hydraulic cylinder 74 to alter its effective length, the supporting and housing apparatus 62 can be caused to rotate about shafts 68 in the forward and reverse direction of arrow 76. In this manner, the relative height of the excavating wheel assembly 60 with respect to the frame 30 of the vehicle can be adjusted as desired.

The excavating wheel assembly 60 further comprises two excavating wheels 82 supported from the apparatus 62 for rotation about horizontally extending axis 83. Each excavating wheel 82 includes a pair of rims 84 which extend radially outward along the sides of each wheel. Rims 84 define the overall width of each wheel 82.

A hydraulic or, alternatively, an electric motor 90 is supported from the frame portion 66 and is positioned above and to the rear of the excavating wheels 82. The output shaft 91 of motor 90 is positioned to extend in a direction toward the axis 83 of the wheels 82. A drive shaft 92 is coupled to shaft 91 of the motor 90. The drive shaft 92 is in turn coupled to a conventional right angle gearbox 94. Right angle gearbox 94 is supported from the central portion 64 in a position between the two wheels 82. The right angle gearbox 94 in turn drives a shaft 95 which extends horizontally into each of the wheels 82 and is coupled to one of the rims 84 of each wheel 82. A cylindrical sleeve 96 extends from the housing of gearbox 94. Bearings 98 on the housing of the gearbox 94 and the sleeve 96 rotatably support the rims 84 for rotation around the axis 83. Speed reducer apparatus may be utilized between the shaft 95 and the wheels 82, if desired.

Thus, as the motor 90 is operated, power is transmitted through shaft 92 and gearbox 94 to rotate the wheels 82. Electrical or hydraulic lines can be connected to the motor 90 and suitable controls in cab 23 can be provided for the motor 90.

Figure 4:
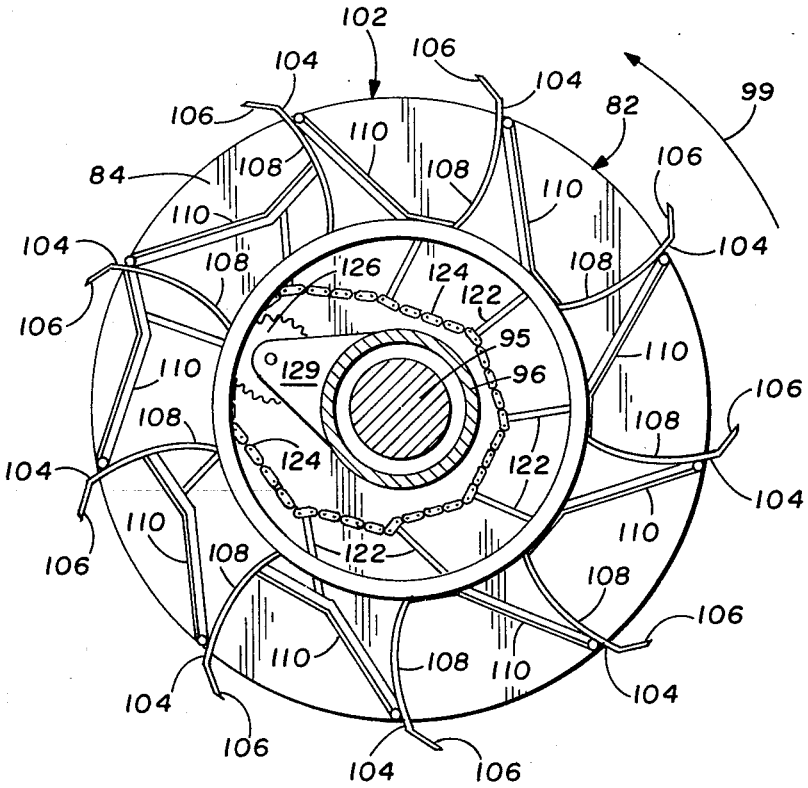
FIG. 4 is a partial section of the system taken on line 4—4 of FIG. 3, looking in the direction of the arrows.

As shown in FIG. 4, each wheel further comprises a plurality of digging buckets 102 which are equally spaced circumferentially around the wheel 82 and extend between the rims 84. The digging buckets 102 each have a cutting edge 104 including a plurality of teeth 106 and a stationary wall 108, extending generally radially inward from the cutting edge 104. Each digging bucket further includes a rear wall 110, which is supported for pivotal movement between a material receiving position and a material dumping position. The operation of the rear wall 110 is best illustrated in FIG. 4, wherein the wall is shown manipulated between the material receiving position when the respective buckets 102 are in the lower and forward positions of their rotary motion and a dumping or material discharge position when the respective buckets are in the upper and rearward positions of their rotary motion.

Referring particularly to FIGS. 3 and 4, an actuating system 120 for the digging buckets of each wheel is shown. The system 120 is located completely in the margins of each of the wheels 82 and comprises a plurality of push rods 122, each of which is connected between one of the rear walls 110 and a chain 124. The chain 124 is generally unconstrained, and extends around a roller 126 which is supported on sleeve 96 by brackets 129. The roller 126 is sprocketed on its outer periphery to engage the chain 124 as the excavating wheel 82 is rotated in a direction of arrow 99 under the action of motor 90, each push rod 122 comes into engagement with roller 126, whereupon its respective rear wall 110 is pushed outwardly into the material discharge position. Subsequently, as each digging bucket is rotated to the lower and forward position of the circular path, the chain operates through push rod 122 to positively return the rear wall 110 to the material receiving position. This positive action of the rear wall 110 in both directions is vastly superior to the arrangements that have been used heretofore wherein the rear portions were allowed to return to the material receiving position under the action of gravity and/or the crowding of excavating material into the buckets. It is envisioned, of course, that other positive acting actuating systems could be used, such as those described in earlier copending application, Ser. No. 435,296, now U.S. Pat. No. 3,896,571, for a MULTI-WHEEL EXCAVATOR AND CONVEYING SYSTEM, granted July 29, 1975, and incorporated herein by reference.

Positioned below and behind the excavating wheel assembly 60 is a moldboard assembly 130. This moldboard assembly 130 extends completely across the width of wheel assembly 60 and is provided to pick up loose material and crowd material in a forward direction as the excavating and loading system 20 moves. The assembly 130 comprises plate 132 which is curved to conform to the path of travel at the edges 104. A blade 133 is positioned adjacent the lower edge of the plate 132. The plate 132 is supported from a pair of arms 134 which pivot from the portion 72 of frame 30 at pivot 135. A link arm 136 is pivotally coupled between the plate 132 and a central portion 64 of the supporting and housing apparatus. A bearing plate 137 is pivotally supported at its leading edge from the rear of plate 132. Selectively operable double-acting hydraulic cylinder means 138 are pivotally attached between the trailing edge of the plates 137 and the plates 132.

Thus, by manipulatinng control means provided in the cab 23, the effective length of the hydraulic cylinder means 138 can be selectively varied to appropriately position the bearing plate 137 with respect to the plate 132 as desired. This bearing plate can be adjusted to set the vertical pressure of the plate to reduce bouncing and stabilize the excavating system.

In addition, the inner connection of the plate 132 through link arm 136 to the supporting and housing means causes the orientation of the blade plate 132 to be determined by the position of the supporting and housing apparatus 62. Hydraulic cylinder 74 controls the position of the supporting and housing apparatus 62 with respect to shaft 68 which will in turn raise and lower the excavating wheels 82. As those of ordinary skill in the art will appreciate, this mechanism will raise and lower the plate 132 proportional to the movement of the excavating wheel 82. This causes the position of the plate 132 and blade 133 to be automatically adjusted as the excavating wheels 82 are raised and lowered.

As is illustrated in FIGS. 1 and 2, the excavating and loading system 20 further includes a loading system 140. The loading system 140 includes a main conveyor 142 comprising an endless belt 144 supported for movement around a course extending angularly upward relative to the frame 30 of the vehicle 22 and including a lower material receiving portion 146 and an upper material discharge portion 148. More particularly, the course of the belt 144 is defined by a plurality of rollers (not shown) which are supported on a conveyor frame 150. The conveyor frame 150 is supported on the frame 30 of the vehicle 22 and includes means supporting the upper portion 148 for pivotal movement about a horizontal axis under the action of a hydraulic cylinder (not shown). This permits control of the vertical height and allows folding of the material delivery portion 148 of the conveyor 142.

Belt 44 of the main conveyor 142 extends around drums mounted at the upper and lower ends of frame 150. The upper and lower drums are rotated by radial hydraulic motors (not shown). By this means, the belt 144 is moved around the course defined by the rollers to move material from the material receiving portion 146 to the material discharge or delivery portion 148.

A chute 160 is supported from the frame 30 behind and below the excavating wheels 82 to receive material discharged from the buckets 102. Chute 160 is shaped to direct material onto the material receiving portion 146 of the main conveyor 142. This chute can also comprise transversely extending conveyors 161 to transport material transverse to the length of the vehicle and onto the material receiving portion 146 of the main conveyor 142. Thus, the material transported onto the material receiving portion 146 is moved upwardly and rearwardly to the material delivery portion 148.

Referring now particularly to FIG. 1, the disclosed embodiment of the invention further includes an auxiliary conveyor system 170. The auxiliary conveyor system 170 includes a frame 172 which is secured to the rear end of frame 30 of the vehicle 22. A turntable 174 is supported on the frame 172 for pivotal movement about a vertical axis under the action of a hydraulic motor (not shown).

An inner conveyor 176 is supported on the turntable 174 to receive material discharged from the material delivery portion 148 of the main conveyor 142. The conveyor 176 comprises a frame which is supported on the turntable 174 and an endless belt mounted for movement around a course defined by a plurality of rollers. The belt is driven by a hydraulic motor and a hydraulic cylinder 182 is provided for controlling the angular relationship of the frame 178 to the turntable 174.

The auxiliary conveyor system 170 further includes an outer conveyor 184 which comprises a frame which is supported from the frame of the inner conveyor by an upper and lower parallel link 188. An endless belt is supported on the frame on the outer conveyor for movement around a course defined by drums positioned at either end thereof. The outer conveyor is driven by a hydraulic motor (not shown) mounted on the frame thereof.

A hydraulic cylinder 200 is pivotally connected between the frames of the inner and outer conveyors of the auxiliary conveyor system 170 to manipulate the outer conveyor 184 with respect to the inner auxiliary conveyor 176. In this manner, the outer conveyor 184 may be manipulated to selectively receive material from the inner conveyor 176.

The operation of the first embodiment of the excavating and loading system 20 incorporating the present invention is illustrated in FIGS. 1–4. System 20 can be moved to the site by means of wheels 24. Hydraulic cylinder 74 can be adjusted as desired so that the excavating wheel assembly 60 will excavate at the desired depth. The drag plate 137 of the moldboard assembly 132 can be adjusted at the desired position by operation of the cylinder 138. Thereafter, the excavating wheels 82 can be rotated to excavate material from in front of the vehicle. This excavation will have a width greater than the following portion of the excavating and loading system 20, and thus, the excavating and loading system 20 can move through the excavation formed by the wheels 82. It will also be appreciated by those of ordinary skill in the art that the supporting and housing apparatus 62 is positioned completely behind the wheels 82 and engages and supports the wheels 82 from the central portion 64. The moldboard assembly 130 cooperates with the excavating wheels 82 and operates to crowd material between the excavating wheels in a forward direction.

The excavating wheels 82 are driven by means of either electrical or hydraulic motors 90 which are coupled through drive shaft 92 to a right angle gearbox 94 positioned wholly within the wheels 82 and the central portion 64. The central portion 64 has a chamber or clearance opening for drive shafts 92 to extend therethrough. The right angle gearbox 94 in turn drives a horizontal extending shaft 95 which is coupled to the wheels 82 to drive them in the direction of arrow 99.

The wheels 82 are rotated and through the movable bucket wall system discharge excavated materials onto the material receiving portion 146 to the conveyor system where it is later transported upward and rearward where it is discharged into a transporting vehicle such as a truck.

Figure 5:
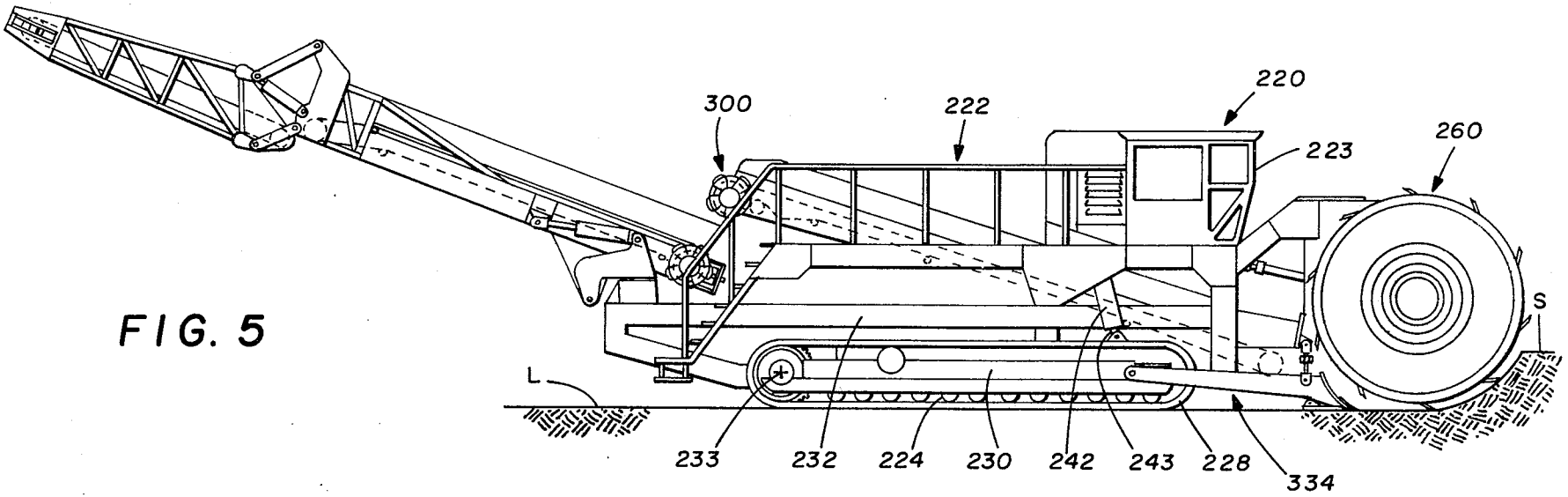
FIG. 5 is a side elevation of the second embodiment of an excavating and loading system comprising the present invention.
Figure 6:
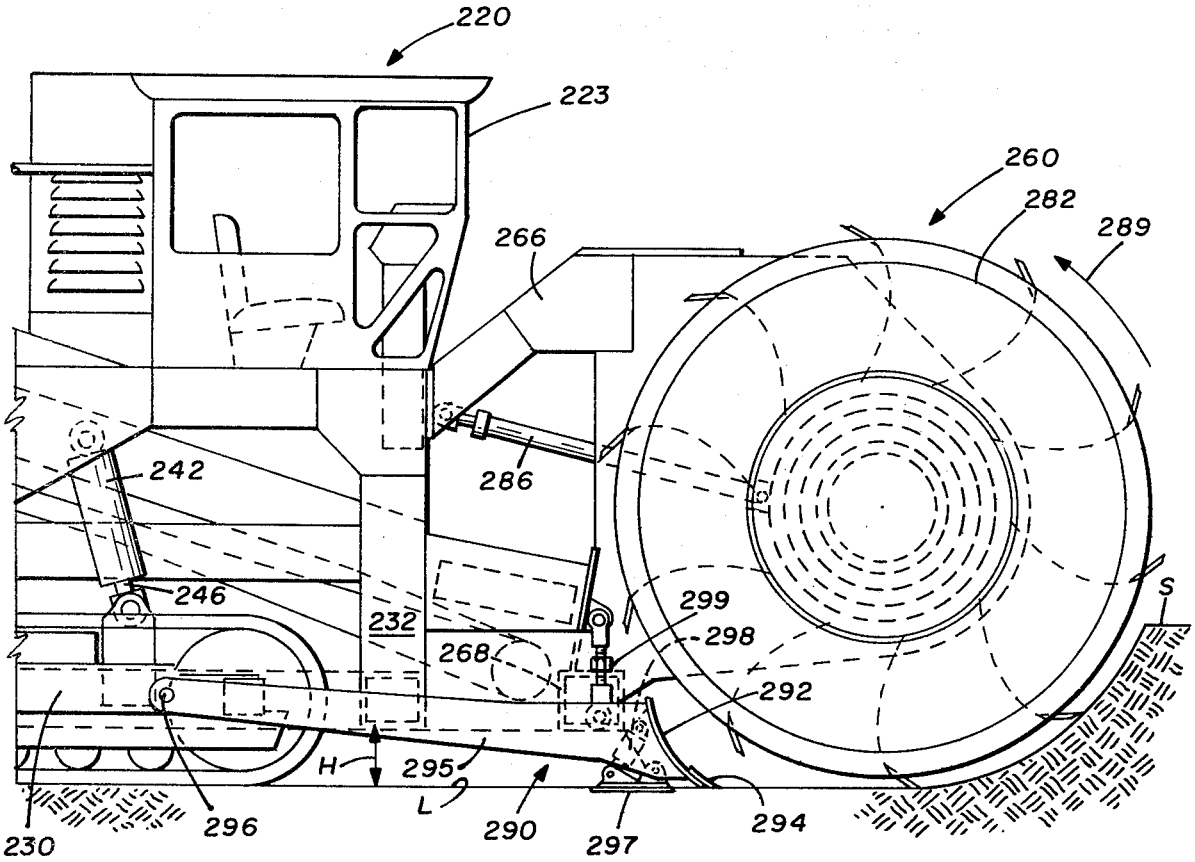
FIG. 6 is a partial enlarged side elevation of the front portion of the excavating and loading system illustrated in FIG. 5.
Figure 7:
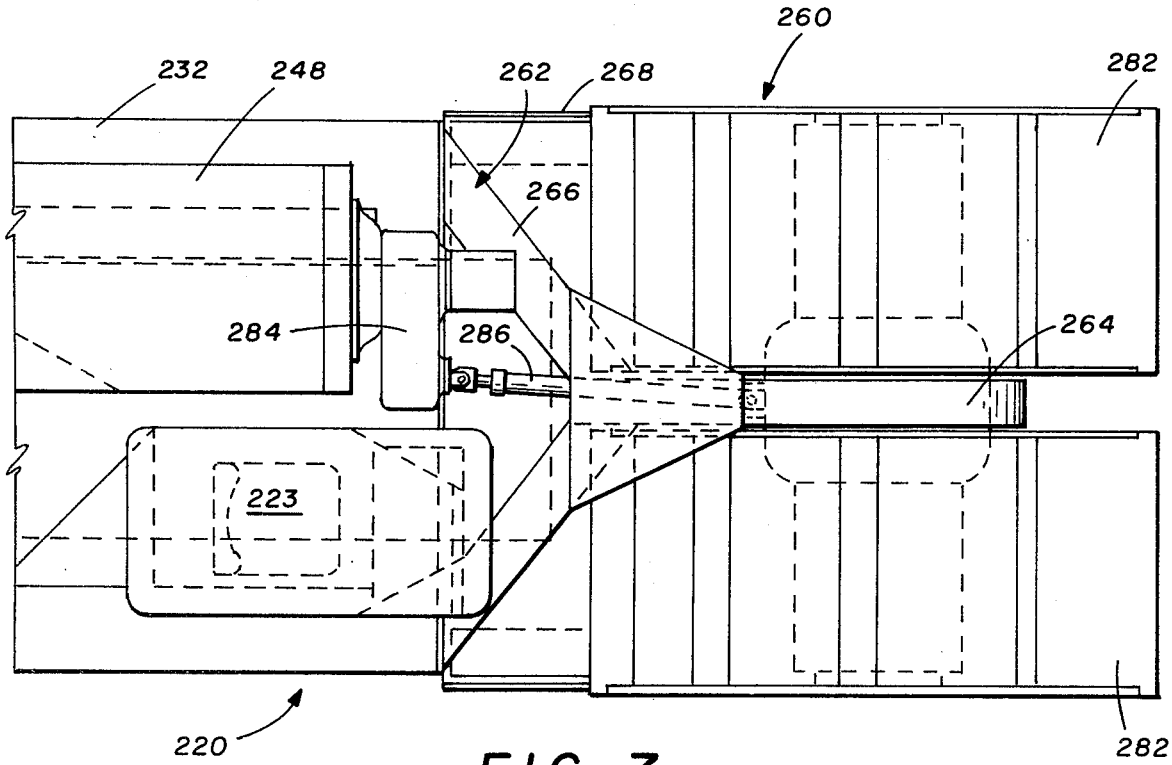
FIG. 7 is a partial enlarged plan view of the front portion of the excavating and loading system illustrated in FIG. 5.

In FIGS. 5, 6 and 7, an alternate configuration of the excavating and loading system is illustrated. In this embodiment, an excavating and loading system 220 is illustrated comprising a vehicle 222 and operator cab 223 with track-type wheels 224 for movement along a surface L. Each of the wheels 224 comprises an endless track 228 whereby the excavating and loading system 220 is adapted for movement over highways and other paved surfaces as well as for operation in unpaved areas, such as during an excavating operation. As is best illustrated in FIG. 5, the wheels 224 are supported from a main frame 230. A subframe 232 is pivotally connected to the main frame 30 at horizontally extending axis 233. The front end 234 of the subframe 232 is connected to the main frame 230 by means of a pair of double-acting hydraulic cylinder assemblies 242. The rod 246 of the hydraulic cylinder assembly 242 is connected to the main frame 230. By selectively actuating hydraulic cylinder 242, height H of the front end 234 of the subframe 232 can be raised or lowered. It is apparent to those skilled in the art that the vehicle 222 could be provided with other types of wheels and frame structures as are well known in the art.

In accordance with the illustrated embodiment of the invention, an engine 248 is supported on the subframe 232. The engine 248 is preferably of the internal combustion type and functions to drive a plurality of hydraulic pumps. The hydraulic pumps in turn supply operating power through suitable controls in the cab 223 for the various components of the excavating and loading system 220. For example, one of the pumps supplies operating power for hydrostatic drive which in turn is coupled to a transmission. The transmission in turn provides power for the wheels 224 to propel the excavating and loading system 220 during the excavating operations and during travel.

An excavating wheel assembly 260 is positioned on the forward portion on the vehicle 222. The excavating wheel assembly 260 includes a supporting and housing apparatus 262 rigidly extending from the front of the subframe 232. The supporting and housing apparatus 262 comprises a central portion 264 connected to the subframe 232 by an upper frame member 266 and a lower frame member 268. The central portion 264 supports two excavating wheels 282 which are identical in construction to excavating wheels 82 illustrated and described particularly with reference to FIG. 3.

As is illustrated in FIG. 7, the engine 248 is mounted on one side of the subframe 232 with the cab 223 mounted to the other side thereof. A transmission 284 is coupled to the engine 248 and has an output drive shaft 286 which extends down through the central portion 264. This drive shaft 286 in turn is coupled to a right angle gearbox (not shown) which is identical in construction and mounting to the gearbox 94 illustrated and described with respect to the embodiment of FIGS. 1–4.

The excavating wheels 282 each have an actuation system identical to that described with respect to the excavating wheels 82. The wheels 282 are positively driven by engine 248 through transmission 284 and drive shaft 286. This drives the excavating wheel 282 in the direction of arrow 289.

Positioned below and behind the excavating wheels 282 is a moldboard assembly 290. This moldboard assembly 290 extends completely across the width of the excavating wheels 282 and is provided to pick up loose material and crowd the material in a forward direction as excavating and loading system 220 moves. This moldboard is particularly adapted to pick up and crowd materials positioned between the two excavating wheels 282 which are left undisturbed by the movement of the excavating wheels. The moldboard assembly 290 comprises a plate 292 which is curved to conform to the path of travel of the edges of the digging teeth on the excavating wheels 282. A cutting blade 294 is positioned adjacent the lower edge of the plate 292. The plate 292 is rigidly supported by a pair of arms 295. These arms 295 are pivotally attached at 296 to the frame 232. A bearing plate 297 is pivotally supported at its leading edge from the rear of plate 292. A selectively operable double-acting hydraulic cylinder means 298 is pivotally coupled between the trailing edge of the bearing plate 297 and the plate 292. A pair of variable length links 299 are coupled between the subframe 232 and the arms 295. In the illustrated embodiment, the link 299 is a turn buckle, but it is to be understood, of course, that other links, such as hydraulic cylinders and the like could be used.

Operation of the moldboard assembly 290 is semi-automatic. The position of the plate 234 and plate 236 is controlled by the relative positions of the frame 230 and subframe 232. By manipulating control means in the cab 223, the effective length of the hydraulic cylinder 298 can be adjusted to set the vertical pressure of the plate to reduce bouncing and stabilize the excavation system.

As is illustrated in FIG. 5, the excavating and loading system 220 further includes a loading system 300. This loading system 300 inlcudes a main conveyor and an auxiliary conveyor and is identical in construction and operation to the loading system described in respect to the embodiment in FIGS. 1–4. Thus, the loading system 300 receives the material discharged from the excavating wheel 282 and can selectively dump material into a material transporting vehicle such as a dump truck or the like.

The operation of the embodiment illustrated in FIGS. 5, 6 and 7 is very similar to the operation in the embodiment of FIGS. 1–4. The primary difference being the fact that the excavation height of the excavation wheel assembly 260 is controlled by the length of the hydraulic cylinder 242 interconnecting the frame and subframe 230 and 232, respectively.

Manipulating controls in the cab 223, the effective length of the hydraulic cylinder 242 is in the raising of the excavating wheel assembly 260 and reducing the excavation depth. Conversely, the shortening of the hydraulic cylinder 242 will lower the excavating wheel assembly 260 thus increasing the depth at which the assembly excavates. The moldboard assembly 290 is semi-automatic in operation and is raised and lowered proportionally to the change in position of the frame and subframe 230 and 232, respectively.

Power is supplied to the excavating wheel 282 through the engine 248, transmission 284, drive shaft 286 and the gearing present within the excavating wheel 282.

As can be appreciated by those of ordinary skill in the art, the combined width of the excavating wheels 282 is wider than the following portion of the vehicle 222 and thus allows the vehicle 222 to move through the excavation as it is formed.

Figure 8:
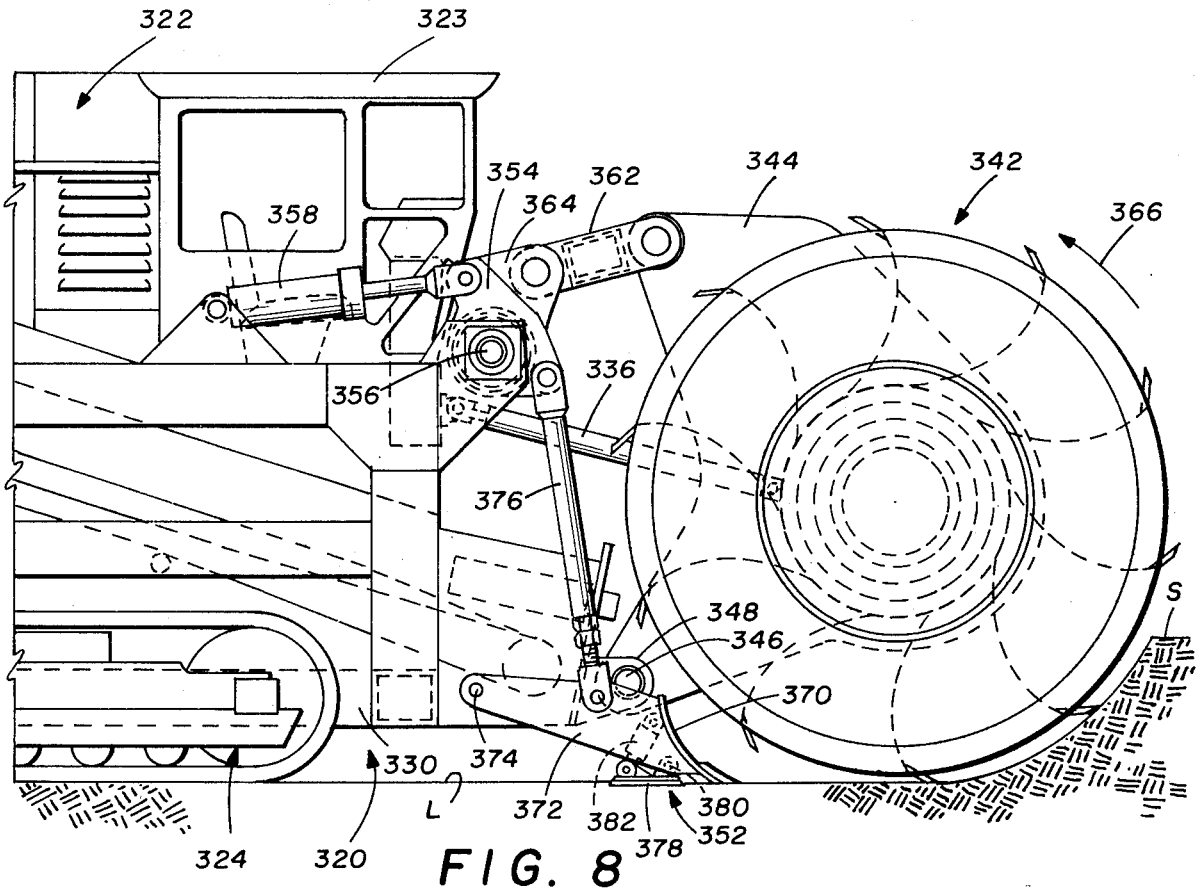
FIG. 8 is a partial enlarged side elevation of a third embodiment of the excavating and loading system of the present invention.
Figure 9:
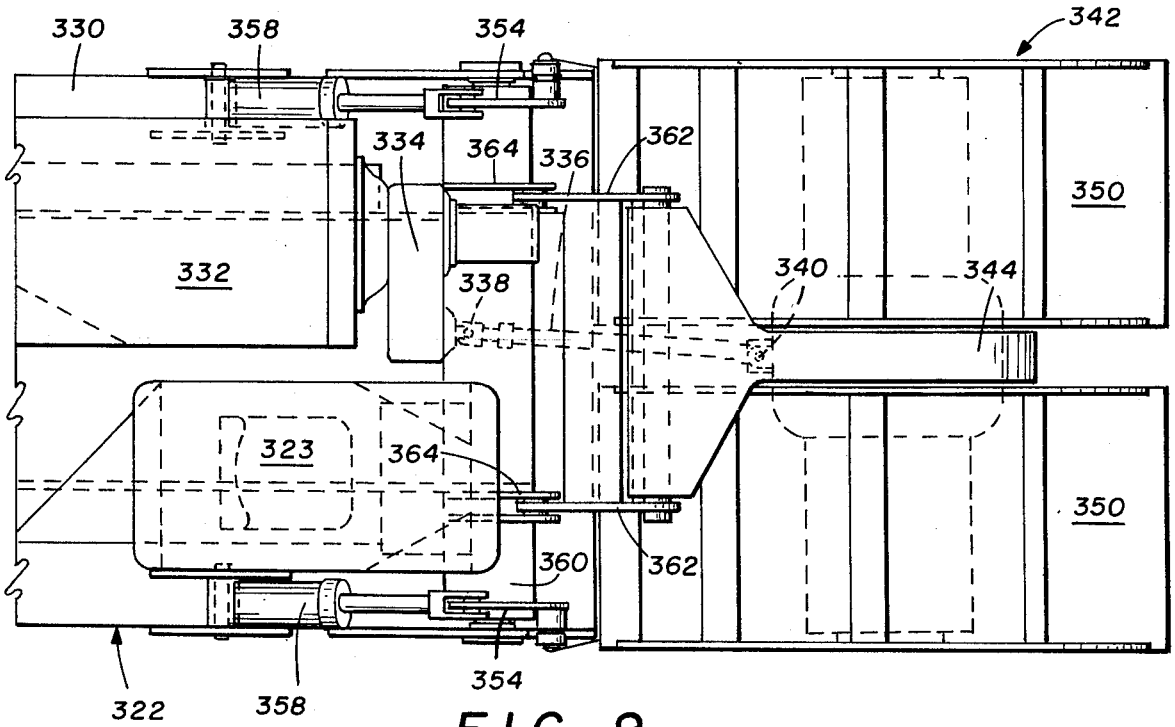
FIG. 9 is a partial enlarged plan view of the front portion of the excavating and loading system illustrated in FIG. 8.

In FIGS. 8 and 9, an alternate configuration of the excavating wheel assembly is illustrated. This third embodiment of the excavating wheel assembly comprises an excavating system 320 comprising a vehicle 322 and operator cab 323 and track-type wheels 324 for movement along the surface L. The wheels 324 are identical to the wheels 224 described with respect to the embodiment of FIGS. 5–7. The wheels 324 are supported from a main frame 330. Main frame 330 in turn supports an engine 332 having a transmission 334 connected thereto. A drive shaft 336 is coupled through a U-joint 338 to transmission 334. A second U-joint 340 is connected to the other end of the drive shaft 336 and is in turn connected to a right angle gearbox within an excavating wheel assembly 342. The excavating wheel assembly 342 is constructed identical to the excavating wheel assemblies 60 and 260 and has the movable bucket walls described in these embodiments. A centrally extending portion 344 is pivotally attached at 346 to a protruding portion 348 of the frame 330. Excavating wheels 350 are pivotally supported from the portion 344 and are driven by shaft 336 as previously described.

The position of the excavating wheel assembly 342 and a moldboard assembly 352 is controlled by a crank linkage. The crank linkage has crank arms 354 which are pivotally attached at 356 to the upper portion of the front of the main frame 330. A hydraulic cylinder 358 is connected between the main frame 330 and the crank arms 354 to selectively control the rotation of the crank arms 354 about the pivot 356. A torque tube 360 rigidly interconnects the crank arms 354 for parallel rotation. Connecting links 362 are pivotally connected between flanges 364 on the torque tube 360 and the centrally extending portion 344. The excavating wheel assembly 342 will be caused to rotate about pivot 346 in the forward and reverse direction of arrow 366, as the cylinder 358 is operated. This in turn will raise and lower the excavating wheels 350 with respect to the ground surface L to control the digging depths.

The moldboard assembly 352 comprises a blade 370 which is rigidly attached to a pair of arms 372 which are in turn pivotally connected to the frame 330 at 374. The blade 370 is positioned under and to the rear of the excavating wheel assembly 342 to pick up and crowd the material in a forward direction. A control link 376 is pivotally connected between each arm 372 and 354. This link 376 is provided with means for selectively altering the length thereof and is utilized to set the position of the blade 370 with respect to the wheel assembly 342. In a likewise manner, it can be seen that by rotating the arm 354 by means of cylinder 358, the arms 372 will be rotated, thus raising and lowering the blade 370. A drag plate 378 is pivotally attached at 380 to the rear of the blade 370. A hydraulic cylinder 382 is connected between the blade 370 and the plate 378 to selectively control the relative position of the plate 378 with respect to the blade 370.

As those of ordinary skill in the art will appreciate, the blade 370 will be raised and lowered proportional to the movement of the excavating wheel assembly 342 while the pressure exerted by the drag plate 378 can be independently adjusted by hydraulic cylinder 382 as the particular situation dictates.

Figure 10:
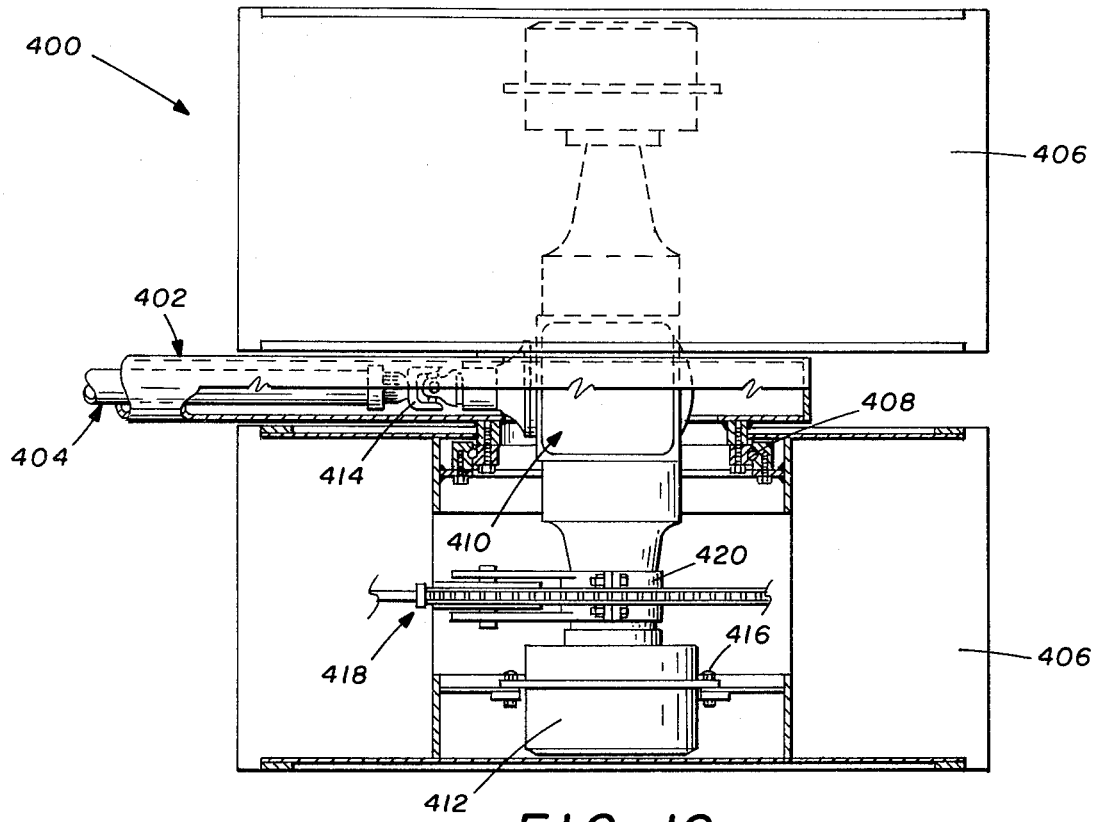
FIG. 10 is a view similar to FIG. 3 of an alternate configuration of an excavation wheel assembly.

An alternate embodiment of the excavating wheel assembly is illustrated in FIG. 10. In this embodiment, an excavating wheel assembly 400 is illustrated supported from a central portion 402 of the supporting and housing means. A drive shaft 404 extends through the central portion 402 and rotatably supports excavating wheel assembly 400. The excavating wheel assembly 400 comprises two excavating wheels 406 which are coaxially positioned on either side of the central portion 402. Each wheel 406 is supported from the central portion by bearing means 408 which are in turn supported from the central portion 402. Conventional planetary axle 410 is centered in the portion 264 with the hubs 412 extending into the wheels 406. The shaft 404 is coupled through a U-joint 414 to the planetary axle assembly 410. In the present embodiment, the planetary axle assembly 410 is of the type manufactured by North American Rockwell as identified by model number P.S. 350. It is to be understood, of course, that other planetary axle assemblies could be utilized. Each of the wheels 406 is coupled to one of the hubs 412 by means of lug bolts 416. In this manner, the drive shaft 404 drives the planetary axle assembly 410, which in turn rotates the hub 412 and excavating wheels 406.

The excavating wheels 406 are very similar in construction to the excavating wheels 82 illustrated in FIGS. 3 and 4. The wheels 406 have movable bucket walls and have an actuating system 418 identical in construction to the actuating system 120 disclosed and described with reference to FIGS. 3 and 4. The actuating system 418 utilizes the sprocket-chain arrangement and is supported from the planetary axle assembly 410 by means of a two-piece bracket 420. The bracket 420 can be bolted around the exterior of one of the extending portions of the planetary axle as illustrated in FIG. 10.

As those of ordinary skill in the art will appreciate, the excavating wheel assembly can be assembled with wheels 406 by utilizing a conventional planetary axle structure as disclosed in FIG. 10.

Figure 11:
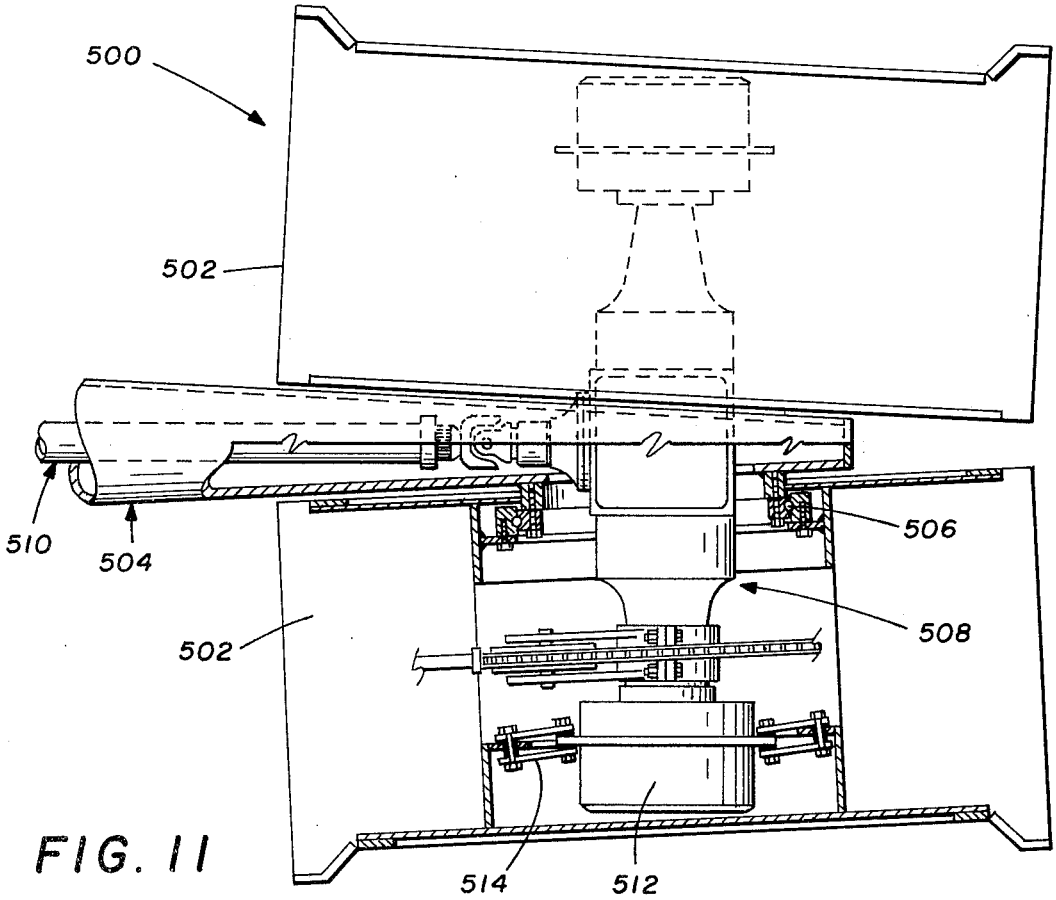
FIG. 11 is a view similar to FIG. 10 of an alternate configuration of the excavation wheel assembly of the present invention.

In FIG. 11, another embodiment of the excavating wheel assembly is illustrated. This excavating wheel assembly 500 is identical in construction to the embodiment illustrated in FIG. 10, except that the excavating wheels 502 are positioned to rotate about axes which are not coaxial. As can be seen in FIG. 11, the central portion 504 tapers in a forward direction and bearings 506 are supported therefrom, thus positioning the wheels 502 to rotate about axes which are inclined with respect to each other. The planetary axle and support hub assembly 508 is coupled to the shaft 510 in a manner described with respect to FIG. 10. The hubs 512 are coupled to the wheels 502 by link assemblies 514. These link assemblies 514 each comprises a pair of parallel bars joined together at their ends by rubber of self-aligning bushings. By constructing links 514 in this manner, the misalignment during rotation of the hub 512 and the wheel 502 can be taken into account by flexure or movement of the links 514 during rotation.

It is apparent to those of ordinary skill in the art that by inclining the excavating wheels 502 in this manner, the unexcavated space between the wheels is reduced.

Figure 12:
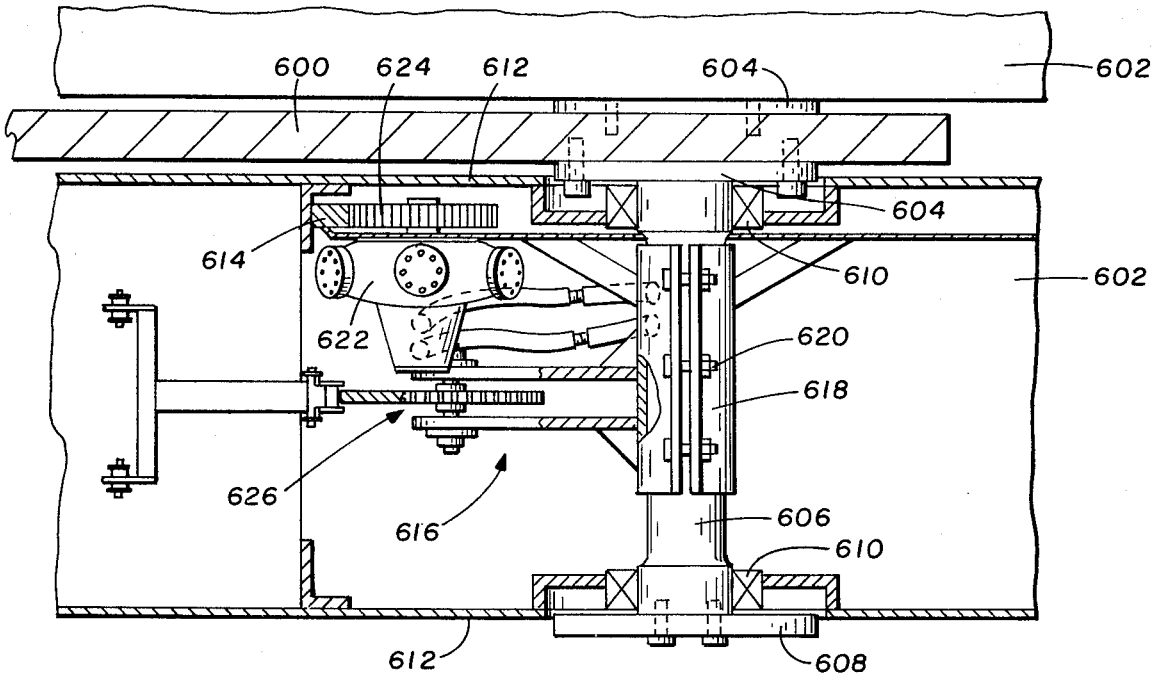
FIG. 12 is a view similar to FIG. 10 of an alternate configuration of the excavating wheel assembly of the present invention.

In FIG. 12, another embodiment of the excavating wheel assembly is illustrated. In this embodiment, a central extending portion 600 is positioned between two excavating wheels 602 which are mounted to rotate about horizontally extending axes. The central portion 600 extends from the supporting and housing means which is in turn coupled to the front of the vehicle. The central portion 600 has a plate 604 bolted to either side thereof. These plates 604 support the excavating wheels 602 which are identical in construction except that they are mirror images of each other. The plate 604 rigidly supports a shaft 606 which extends across the width of the excavating wheel 602. A plate 608 is bolted to the outer extending end of the shaft 606 to retain the excavating wheel 602 thereon. Bearings 610 rotatably support the rims 612 of the excavating wheel 602 on the shaft 606. A ring gear 614 is mounted inside of the excavating wheel assembly and is connected to the interior rim 612. An actuating and drive assembly 616 is supported from the shaft 606 by two-part bracket 618. The two-part bracket 618 is connected together by fasteners 620 which allow the assembly 616 to be mounted therein. A hydraulic or electric motor 622 is supported from the bracket 618 and has an output sprocket 624 which engages the ring gear 614. Upon the actuation of the motor 622, the excavating wheel 602 will be caused to rotate through interaction of the sprocket 624 and ring gear 614. In addition, a bucket actuating assembly 626 is supported from the bracket 618. The actuating assembly 626 is identical to the actuating system 120 illustrated and disclosed by reference to FIGS. 3 and 4.

From the foregoing, it will be understood that the present invention comprises additional improvements relating to excavating and loading systems disclosed and claimed in copending application, Ser. 435,296, filed Jan. 21, 1974, for MULTI-WHEELED EXCAVATOR AND CONVEYING SYSTEM, now U.S. Pat. No. 3,896,571, granted July 29, 1975.

Thus, in accordance with the invention described herein, an excavating and loading system comprising a vehicle having an excavating wheel assembly supported at the front thereof is provided for excavating the material and transferring the material to a main conveyor whereupon the material is conveyed to the rear of the vehicle. The excavating wheel assembly comprises two excavating wheels which are supported from a central portion and are wider in overall width than the following portion of the vehicle. The supporting and housing apparatus which supports the excavating wheel from the vehicle provides a space for allowing the drive shaft extending from a motor to be coupled with a right angle gearbox to drive the excavating wheel itself. In this manner, the excavating wheel forms an excavation wider than the following portion of the vehicle allowing the vehicle to be supported and traveled through the excavation as it is formed.

The advantages of this particular arrangement allow for a narrow central portion, which in turn reduces the amount of material missed by the two excavating wheel assemblies. In addition, this arrangement provides for all the supporting and housing means to be positioned either between or directly behind the excavating wheel assembly and permits operation of the excavating and loading system within the excavation that is being formed. This materially reduces the amount of movement of the excavating wheel assembly necessary to position the assembly for excavation and travel and thereby reduces the overall complexity of the excavating and loading system incorporating the present invention.

It is also envisioned that the embodiment of FIGS. 1 through 4 could, for example, have suitable apparatus mounted on the front of the vehicle 22 to provide pitch and roll adjustment for the excavating wheel assembly 60. This apparatus could simultaneously move the conveyor 142, chute 160 and moldboard assembly 130 as a unit with the excavating wheel assembly 60 to minimize clearance between these elements and reduce spillage.

It is to be understood, of course, by those of ordinary skill in the art, that although particular embodiments of the invention have been illustrated in the accompanying Drawings and described in the foregoing Detailed Description, it would be understood that the invention is not limited to the embodiments disclosed, but is capable of numerous rearrangements, modifications and substitutions of parts and elements without departing from the spirit and scope of the invention as defined in the appended claims.

What is claimed is:

1. An excavating and loading system comprising:

an excavating wheel assembly comprising two rigid excavating wheels, said excavating wheel assembly having a width at least equal to the widest portion of the remainder of the system;

each of said excavating wheels including a plurality of digging buckets located immediately adjacent one another to define the entire circumference of the excavating wheel, each bucket having a cutting edge which extends to a stationary wall, and a wall mounted for pivotal movement from a material receiving position to a material dumping position;

supporting and housing means extending between the two excavating wheels for supporting the excavating wheel assembly;

means supporting the two excavating wheels cantilever on the supporting and housing means for rotation with respect thereto;

each of said digging buckets extending continuously between a side wall thereof located immediately adjacent to the supporting and housing means and a side wall thereof defining one end of the excavating wheel assembly;

drive means for rotating the excavating wheels so that the digging buckets follow a circular path;

means located within the margins of the excavating wheel assembly and responsive to rotation of the excavating wheels for positively pivoting the movable wall of each digging bucket of the excavating wheels to the material receiving position when the bucket is in the lower and forward portion of the path and for positively pivoting the movable wall to the material dumping position when the bucket is in the upper and rearward portion of the path;

a vehicle for supporting and manipulating the excavating wheel supporting means and thereby positioning the excavating wheel assembly in engagement with material to be excavated; and conveyor means mounted on the vehicle behind the excavating wheel assembly for movement around a course including a relatively low portion positioned to receive material from the digging buckets of the excavating wheels upon the positioning of the movable walls of the buckets in the material dumping position and a relatively high material delivery portion located rearwardly on the vehicle from the low portion.

2. The excavating and loading system according to claim 1 wherein the supporting and housing means includes a central portion extending from the vehicle between the two excavating wheels and opposed arms extending in opposite directions from the central portion into the excavating wheels, and wherein the means supporting the excavating wheels for rotation include bearing means supporting the excavating wheels on the arms of the supporting and housing means.

3. The excavating and loading system according to claim 2 wherein the two excavating wheels are mounted for rotation about angularly offset axes.

4. An excavating and loading system comprising:

an excavating wheel assembly comprising two rigid excavating wheels, said excavating wheel assembly having a width at least equal to the widest portion of the remainder of the system;

each of said excavating wheels including a plurality of digging buckets located immediately adjacent one another to define the entire circumference of the excavating wheel, each bucket having a cutting edge which extends to a stationary wall, and a wall mounted for pivotal movement from a material receiving position to a material dumping position;

supporting and housing means extending between the two excavating wheels for supporting the excavating wheel assembly;

means supporting the two excavating wheels cantilever on the supporting and housing means for rotation with respect thereto;

each of said digging buckets extending continuously between a side wall thereof located immediately adjacent to the supporting and housing means and a side wall thereof defining one end of the excavating wheel assembly;

drive means for rotating the excavating wheels so that the digging buckets follow a circular path;

means located within the margins of the excavating wheel assembly and responsive to rotation of the excavating wheels for positively pivoting the movable wall of each digging bucket of the excavating wheels to the material receiving position when the bucket is in the lower and forward portion of the path and for positively pivoting the movable wall to the material dumping position when the bucket is in the upper and rearward portion of the path;

a vehicle for supporting and manipulating the excavating wheel supporting means and thereby positioning the excavating wheel assembly in engagement with material to be excavated;

conveyor means mounted on the vehicle behind the excavating wheel assembly for movement around a course including a relatively low portion positioned to receive material from the digging buckets of the excavating wheels upon the positioning of the movable walls of the buckets in the material dumping position and a relatively high material delivery portion located rearwardly on the vehicle from the low portion;

said supporting and housing means including a central portion extending from the vehicle between the two excavating wheels and opposed arms extending in opposite directions from the central portion into the excavating wheels;

the means supporting the excavating wheels for rotation including bearing means supporting the excavating wheels on the arms of the supporting and housing means;

a drive shaft extending through the central portion of the supporting and housing means;

right angle drive means driven by the drive shaft and located at the intersection of the central portion and the arms of the supporting and housing means;

said right angle drive means having dual outputs each extending through one of the arms; and speed reducer means each driven by one of the outputs of the right angle drive means and in turn drivingly connected to one of the excavating wheels to effect rotation thereof.

5. The excavating and loading system according to claim 4 wherein the two excavating wheels are mounted for rotation about angularly offset axes.

6. The excavating and loading system according to claim 2 further characterized by:

dual motor means each mounted within one of the excavating wheels and each having an output;

means drivingly connected to the output of each motor means to the surrounding excavating wheel whereby the motor means effect rotation of the excavating wheel; and means extending through at least the central portion of the supporting and housing means for supplying operating power from the vehicle to the motor means.

7. An excavating and loading system comprising:

a vehicle;

supporting and housing means including a central portion extending forwardly from the vehicle and a pair of arms extending laterally outwardly in opposite directions from the central portion;

an excavating wheel assembly comprising at least two rigid excavating wheels, said excavating wheel assembly having a width at least equal to the widest portion of the remainder of the system;

means supporting the two excavating wheels cantilever on the arms of the supporting and housing means for rotation with respect thereto;

each of said excavating wheels including a plurality of digging buckets located immediately adjacent one another to define the entire circumference of the excavating wheel, each bucket having a cutting edge which extends to a stationary wall, and a wall mounted for pivotal movement from a material receiving position to a material dumping position;

each of said digging buckets extending continuously between a side wall thereof located immediately adjacent to the central portion of the supporting and housing means and a side wall thereof defining one end of the excavating wheel assembly;

means for rotating the excavating wheels so that the digging buckets follow a circular path;

means extending through at least the central portion of the supporting and housing means for supplying operating power to the excavating wheel rotating means;

means located within the margins of the excavating wheel assembly and responsive to rotation of the excavating wheels for positively positioning the movable wall of each digging bucket of the excavating wheel in the material dumping position when the bucket is in the upper and rearward portion of the path; and conveyor means mounted on the vehicle behind the excavating wheel assembly for movement around a course including a relatively low portion positioned to receive material from the digging buckets of the excavating wheels upon the positioning of the movable walls of the buckets in the material dumping position and a relatively high material delivery position located rearwardly on the vehicle from the low portion.

8. The excavating and loading system according to claim 7 wherein the arms of the supporting and housing means extend angularly forwardly from the points of connection to the central portion so that the excavating wheels are supported for rotation about angularly offset axes, and so that the forward portions of the excavating wheels are positioned in a relatively adjacent and the rear portions of the excavating wheels are positioned in a relatively spaced apart relationship.

9. An excavating and loading system comprising:

a vehicle;

supporting and housing means including a central portion extending forwardly from the vehicle and a pair of arms extending laterally outwardly in opposite directions from the central portion;

an excavating wheel assembly comprising at least two rigid excavating wheels, said excavating wheel assembly having a width at least equal to the widest portion of the remainder of the system;

means supporting the two excavating wheels cantilever on the arms of the supporting and housing means for rotation with respect thereto;

each of said excavating wheels including a plurality of digging buckets located immediately adjacent one another to define the entire circumference of the excavating wheel, each bucket having a cutting edge which extends to a stationary wall, and a wall mounted for pivotal movement from a material receiving position to a material dumping position;

each of said digging buckets extending continuously between a side wall thereof located immediately adjacent to the central portion of the supporting and housing means and a side wall thereof defining one end of the excavating wheel assembly;

means for rotating the excavating wheels so that the digging buckets follow a circular path;

means extending through at least the central portion of the supporting and housing means for supplying operating power to the excavating wheel rotating means;

means located within the margins of the excavating wheel assembly and responsive to rotation of the excavating wheels for positively positioning the movable wall of each digging bucket of the excavating wheel in the material dumping position when the bucket is in the upper and rearward portion of the path;

conveyor means mounted on the vehicle behind the excavating wheel assembly for movement around a course including a relatively low portion positioned to receive material from the digging buckets of the excavating wheels upon the positioning of the movable walls of the buckets in the material dumping position and a relatively high material delivery position located rearwardly on the vehicle from the low portion;

drive shaft means extending from the vehicle through the central portion of the supporting and housing means;

right angle drive means mounted at the intersection of the central portion and the arms of the supporting and housing means and having an input drivingly connected to the drive shaft means;

said right angle drive means further characterized by dual outputs extending to the arms of the supporting and housing means; and dual speed reducer means each driven by one of the outputs of the right angle drive means and in turn drivingly connected to one of the wheels for effecting rotation thereof under the action of operating power supplied by the drive shaft means.

10. The excavating and loading system according to claim 9 wherein the two excavating wheels are mounted for rotation about angularly offset axes.

11. The excavating and loading system according to claim 7 further characterized by:

a pair of motors each supported on one of the arms of the supporting and housing means and each positioned within one of the excavating wheels, each of said motors having an output;

means drivingly interconnecting the output of each motor and the surrounding excavating wheel; and means extending through at least the central portion of the supporting and housing means for supplying operating power to the motors.

12. An excavating and loading system comprising:

a vehicle;

supporting and housing means extending forwardly from the vehicle and including a central portion and arms extending laterally outwardly from the central portion in opposite directions;

an excavating wheel assembly comprising two rigid excavating wheels, said excavating wheel assembly having a width at least equal to the widest portion of the remainder of the system;

each of said excavating wheels including a plurality of digging buckets located immediately adjacent one another to define the entire circumference of the excavating wheel, each bucket having a cutting edge which extends to a stationary wall, and a wall mounted for pivotal movement between a material receiving position and a material dumping position;

each of said digging buckets extending continuously between a side wall thereof located immediately adajacent to the central portion of the supporting and housing means and a side wall thereof defining one end of the excavating wheel assembly;

means supporting the two excavating wheels cantilever on the arms of the supporting and housing means for rotation with respect thereto;

drive shaft means extending through the central portion of the supporting and housing means;

right angle drive means mounted at the intersection of the central portion and the arms of the supporting and housing means, said right angle drive means including an input drivingly connected to the drive shaft means and dual outputs extending through the arms of the supporting and housing means;

speed reducer means each drivingly connected to one output of the right angle drive means and in turn drivingly connected to one of the wheels for effecting rotation thereof under the action of operating power supplied by the drive shaft means;

means located within the margins of the excavating wheel assembly and responsive to rotation of the excavating wheels for positively positioning the movable wall of each digging bucket in the material dumping position when the bucket is in the upper and rearward portion of the path; and conveyor means mounted on the vehicle behind the excavating wheel assembly for movement around a course including a relatively low portion positioned to receive material from the digging buckets of the excavating wheels upon the positioning of the movable walls of the buckets in the material dumping position and a relatively high material delivery position located rearwardly on the vehicle from the low portion.

13. The excavating and loading system according to claim 12 wherein the speed reducer means each comprises a planetary gearset supported in one of the arms of the supporting and housing means and having an output drivingly connected to the surrounding excavating wheel.

14. The excavating and loading system according to claim 12 further characterized by motor means mounted on the supporting and housing means and having an output drivingly connected to the drive shaft means.

15. The excavating and loading system according to claim 12 further characterized by engine means mounted on the vehicle and having an output, and means forming a driving connection between the output of the engine means and the drive shaft means.

16. The excavating and loading system according to claim 12 wherein the two excavating wheels are supported on the arms of the supporting and housing means for rotation about axes extending angularly forwardly so that the forward portions of the two excavating wheels are located more closely adjacent one another than the rearward portions thereof.

17. An excavating and loading system comprising:

a vehicle;

supporting and housing means including a central portion extending forwardly from the vehicle and a pair of arms extending laterally outwardly in opposite directions from the central portion;

an excavating wheel assembly comprising two rigid excavating wheels, said excavating wheel assembly having a width at least equal to the widest portion of the remainder of the system;

means supporting the two excavating wheels cantilever on the arms of the supporting and housing means for rotation with respect thereto;

each of said excavating wheels including a plurality of digging buckets located immediately adjacent one another to define the entire circumference of the excavating wheel, each bucket having a cutting edge which extends to a stationary wall, and a wall mounted for pivotal movement between a material receiving position and a material dumping position;

each of said digging buckets extending continuously between a side wall thereof located immediately adjacent to the central portion of the supporting and housing means and a side wall thereof defining one end of the excavating wheel assembly;

a pair of excavating wheel rotating motors each mounted within one of the excavating wheels and each supported on one of the arms of the supporting and housing means, each of said excavating wheel rotating motors having an output;

means forming a driving connection between the output of each motor and the surrounding excavating wheel whereby the motor functions to effect rotation of the excavating wheel;

means located within the margins of the excavating wheel assembly and responsive for rotation of the excavating wheels for positively positioning the movable wall of each digging bucket of the excavating wheel in the material dumping position when the bucket is in the upper and rearward part of the path; and conveyor means mounted on the vehicle behind the excavating wheel assembly for movement around a course including a relatively low portion positioned to receive material from the digging buckets of the excavating wheels upon the positioning of the movable walls of the buckets in the material dumping position and a relatively high material delivery portion located rearwardly on the vehicle from the low portion.

* * * * *